US009649547B2

(12) United States Patent
White

(10) Patent No.: US 9,649,547 B2
(45) Date of Patent: May 16, 2017

(54) BASEBALL AND SOFTBALL EQUIPMENT ORGANIZER

(71) Applicant: Louis White, Inver Grove Heights, MN (US)

(72) Inventor: Louis White, Inver Grove Heights, MN (US)

( * ) Notice: Subject to any disclaimer, the term of this patent is extended or adjusted under 35 U.S.C. 154(b) by 392 days.

(21) Appl. No.: 14/201,012

(22) Filed: Mar. 7, 2014

(65) Prior Publication Data

US 2014/0250673 A1 Sep. 11, 2014

Related U.S. Application Data

(60) Provisional application No. 61/773,922, filed on Mar. 7, 2013.

(51) Int. Cl.

| | |
|---|---|
| ***A47F 7/00*** | (2006.01) |
| ***A47F 5/08*** | (2006.01) |
| ***A63B 71/00*** | (2006.01) |
| *A63B 71/02* | (2006.01) |
| *A63B 102/18* | (2015.01) |

(52) U.S. Cl.

CPC ..... *A63B 71/0045* (2013.01); *A63B 71/022* (2013.01); *A63B 2102/18* (2015.10); *A63B 2210/50* (2013.01); *Y10T 29/49959* (2015.01)

(58) Field of Classification Search

CPC ..... A47F 5/0006; A47F 5/08; A47F 5/0815; A47F 13/512; A47L 13/51; F16B 45/00; A47G 29/083; A47G 25/0607; A47G 25/12; A47G 25/08; B25H 3/04; A47K 2201/02; A47K 2201/025; A63C 11/02; A63C 11/021; A47B 81/00; A47B 81/005; A47B 81/007; A63B 71/0045; A63B 2102/18; A63B 2210/50; A63B 71/022; Y10T 29/49959

USPC .... 29/428, 525.08; 211/66, 70.2, 70.5, 70.6, 211/70.7, 70.8, 85.7, 87.01, 88.01, 113; 248/690, 691, 304, 305, 306, 3, 39

See application file for complete search history.

(56) References Cited

U.S. PATENT DOCUMENTS

| | | | | |
|---|---|---|---|---|
| 4,049,126 A | | 9/1977 | Halverson | |
| 5,203,462 A | * | 4/1993 | Brooks | A63B 71/0036 211/14 |
| 5,294,005 A | * | 3/1994 | Hedges | A47F 5/083 211/60.1 |
| 5,386,986 A | * | 2/1995 | Gamboa | A63B 69/0079 473/430 |

(Continued)

OTHER PUBLICATIONS

"U.S. Appl. No. 14/200,799, Non Final Office Action mailed Mar. 24, 2016", 27 pgs.

*Primary Examiner* — Sarang Afzali
*Assistant Examiner* — Darrell C Ford

(57) ABSTRACT

A baseball and softball equipment organizer includes a base with front and back surfaces, at least one hingable element attached to the front surface of the base with at least one arm rotatably coupled to the hingable element and at least one hook attached to the back surface of the base for removable attachment of the organizer to a chain link fence. The at least one arm can rotate from a first position generally parallel to the base to a second position generally orthogonal to the base. The outside surface of at least one arm can include a gripping material to organize batting gloves and other sports items. A method of using the organizer is described.

20 Claims, 7 Drawing Sheets

(56) References Cited

U.S. PATENT DOCUMENTS

D356,002 S * 3/1995 Morgan ..... D6/552
5,566,843 A * 10/1996 Kruska ..... A47G 25/065 211/1.3
5,582,377 A 12/1996 Quesada et al.
5,871,105 A * 2/1999 Whitehead ..... A47B 81/00 211/14
D417,807 S * 12/1999 McBarnette ..... D6/513
6,029,830 A * 2/2000 Manookian ..... A47F 5/083 211/118
6,164,465 A * 12/2000 Schroeder ..... A47B 43/00 211/149
6,364,411 B1 * 4/2002 Zheng ..... A47C 7/62 297/135
6,749,074 B1 6/2004 Hileman et al.
7,090,085 B1 * 8/2006 Vicendese ..... A47F 5/08 211/106.01
7,273,153 B1 9/2007 Kuniyoshi
8,245,858 B2 8/2012 Doran
8,523,127 B1 * 9/2013 Bennett ..... A47F 5/083 211/85.7
8,616,385 B1 * 12/2013 Doran ..... A63B 71/0036 211/85.7
2003/0116688 A1 * 6/2003 Furukawa ..... A47F 5/0006 248/339
2005/0115853 A1 6/2005 Craft
2005/0194335 A1 9/2005 Hibner
2006/0032828 A1 * 2/2006 Chiu ..... A47B 13/02 211/66
2006/0226321 A1 10/2006 Tracy et al.
2009/0188819 A1 * 7/2009 Carney, Jr. ..... A47B 43/003 206/315.1
2010/0282935 A1 * 11/2010 Zannoni ..... A47G 23/0225 248/224.8
2010/0283272 A1 * 11/2010 Schneider ..... B60R 19/54 293/115
2011/0100939 A1 * 5/2011 Friesch ..... A63B 71/0045 211/85.7
2011/0174945 A1 7/2011 Wood
2012/0074083 A1 * 3/2012 Geils ..... A63B 71/0045 211/85.7
2012/0187061 A1 * 7/2012 Doran ..... A47B 81/00 211/85.7
2013/0082155 A1 * 4/2013 McCormack ..... A63B 69/0002 248/220.21
2013/0126453 A1 5/2013 Flickinger
2014/0250672 A1 * 9/2014 White ..... A63B 71/0045 29/525.08
2014/0250673 A1 * 9/2014 White ..... A63B 71/0045 29/525.08

* cited by examiner

BASEBALL AND SOFTBALL EQUIPMENT ORGANIZER

CLAIM OF PRIORITY

This patent application claims the benefit of priority under 35 U.S.C. §119(e) of White, U.S. Provisional Patent Application Ser. No. 61/773,922 entitled "Baseball and Softball Equipment Organizer," filed on Mar. 7, 2013, which is hereby incorporated by reference herein in its entirety.

TECHNICAL FIELD

This organizer relates to the field of organizing baseball and softball player bats. More specifically, the organizer comprises the placement and storage of bats and sometimes helmets of the baseball player during a ball game being played.

BACKGROUND

There are known devices for a Bat Rack. Most of these are hard, fixed, and usually bulky in nature to hang multiple baseball bats and sometimes batting helmets. One good example is the permanent fixed, metal, multiple bat rack, which is traditionally mounted in one spot in the team's bench area and is shared by all the team members during a ball game being played.

These devices usually result in the bats and helmets getting piled on top of one another, lying on the ground and creates a very cluttered area that causes a hazard area and becomes a danger of a ball player injuring themselves.

OVERVIEW

The present organizer comprises the ball players personal baseball equipment organizing and storing device that will attach to a chain link fence. The device consists of a solid base with two base attachment hooks fixed to the back side of the device spaced equally apart attaching the device to anyone of the diamond patterns of a chain link fence. This gives each team member the ability to store their personal baseball equipment; a bat, a ball glove, a hat, and a pair of batting gloves, by rotating the organizing arms with gripping material that is attached to the base by two pivot mounts, in the down position 90 degrees, until the arms come to rest on the built in stops that are created by two slot openings placed in the device base.

The ball player has the capability to place the device anywhere in the bench area, or where the ball player chooses to place the device on any diamond pattern of a chain link fence of the baseball field, the device can be easily removed from the chain link fence and with the arms rotated 90 degrees in the up position, the device becomes compact for easy storing and portability when no longer in use.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
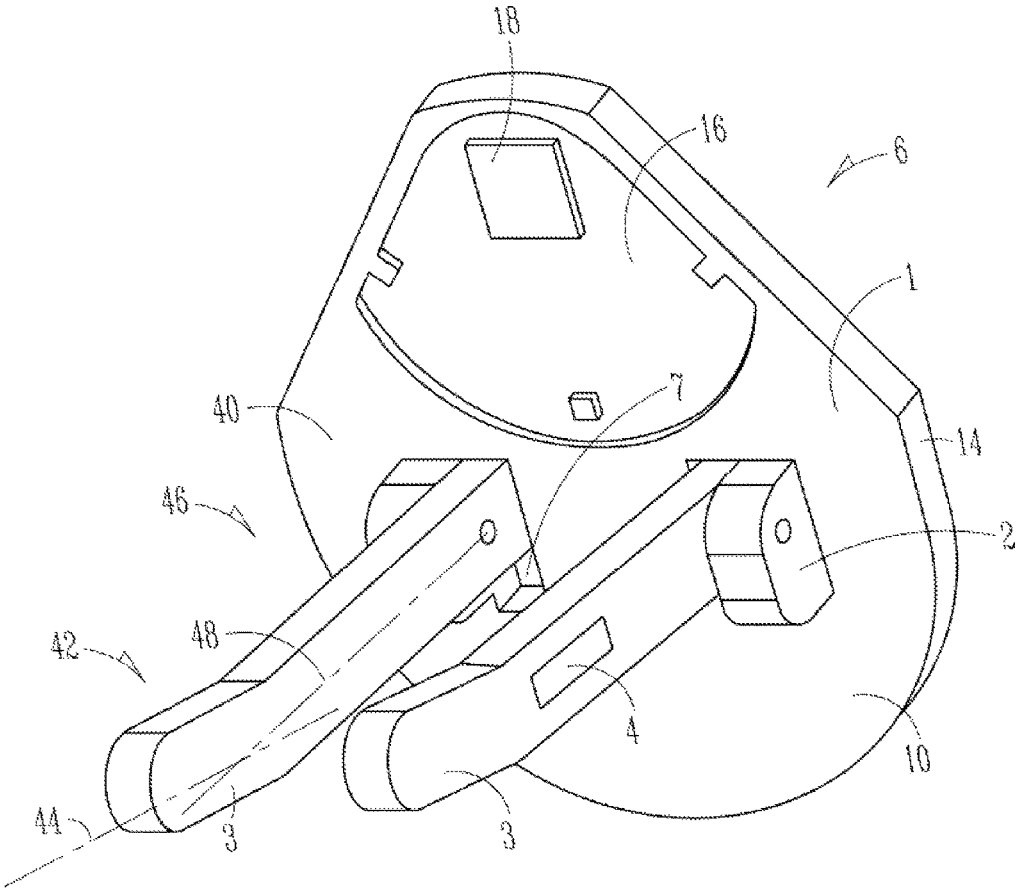
FIG. 1 is a perspective view, showing the front side of an example of an equipment organizer device.

FIG. 1 shows a perspective front view of an example of a baseball and softball equipment organizer device 6, in an assembled state. The baseball and softball equipment organizer device 6 includes a base 1, pivot mounts 2, organizing arms 3 and gripping material 4, which make up the various components of the device. The device is configured to be attached anywhere along the chain link fence of the baseball or softball playing field, but typically in the ball team bench area.

The base 1 can include a front surface 10, a back surface 12 (see FIG. 2) and an edge surface 14 between the front surface 10 and back surface 12. The base 1 can be constructed from a variety of materials including, but not limited to, polymer materials (including plastics), metal, wood or other materials of sufficient rigidity. The edge surface 14 can vary in thickness depending on the material used to construct the base 1. In an example, the base 1 can be constructed from metal with a first thickness. In another example, the base 1 can be constructed from plastic with a second thickness where the second thickness can be greater than the first thickness.

The base 1 can assume a variety of shapes including, but not limited to, round, square, triangular, rhomboidal, geometric shapes with planar symmetry about at least one axis or non-symmetric geometric shapes. The base 1 can include recessed features 16 that extend below the plane of the front surface 10 into the thickness 14 of base 1 or proud features 18 that can extend above the plane of the recessed feature 16. In an example, various recessed features 16 and proud features 18 can be combined to form a structure to inform a user of the functionality of device 1. In an example, recessed features 16 and proud features 18 can visually suggest a baseball playing field.

The organizing arms 3 can include a first arm 3 and a second arm 3. Each arm can include a proximal portion 40 that can rotatably attach to a pivot mount 2, a distal portion 42 with a distal axis 44, and a central portion 46 between the proximal portion 40 and the distal portion 42 with a central axis 48. In an example, the distal axis 44 can be inclined from the central axis 48 so that the distal portion 42 can be offset with respect to the central portion 46. One or both of the first and second arms 3 can include a gripping material 4 that can be attached to an outside surface of the organizing arm 3.

The base 1 can include at least one slot 7. (See FIG. 2) In some examples, the slot 7 can protrude through the front surface 10 into the base 1. In some examples, the slot 7 can extend from the front surface 10 through the base 1 to the back surface 12.

In an example, each organizing arm 3 can rotate about the pivot mount 2 so that a segment of the proximal portion 40 of the organizing arm 3 can interfere with a segment of slot 7 thereby limiting further rotation of the arm 3. The location of the slot 7 on the base 1 with respect to the proximal portion 40 of the organizing arm 3 can control the amount of rotation the organizing arm 3 experiences about the pivot mount 2.

Figure 2:
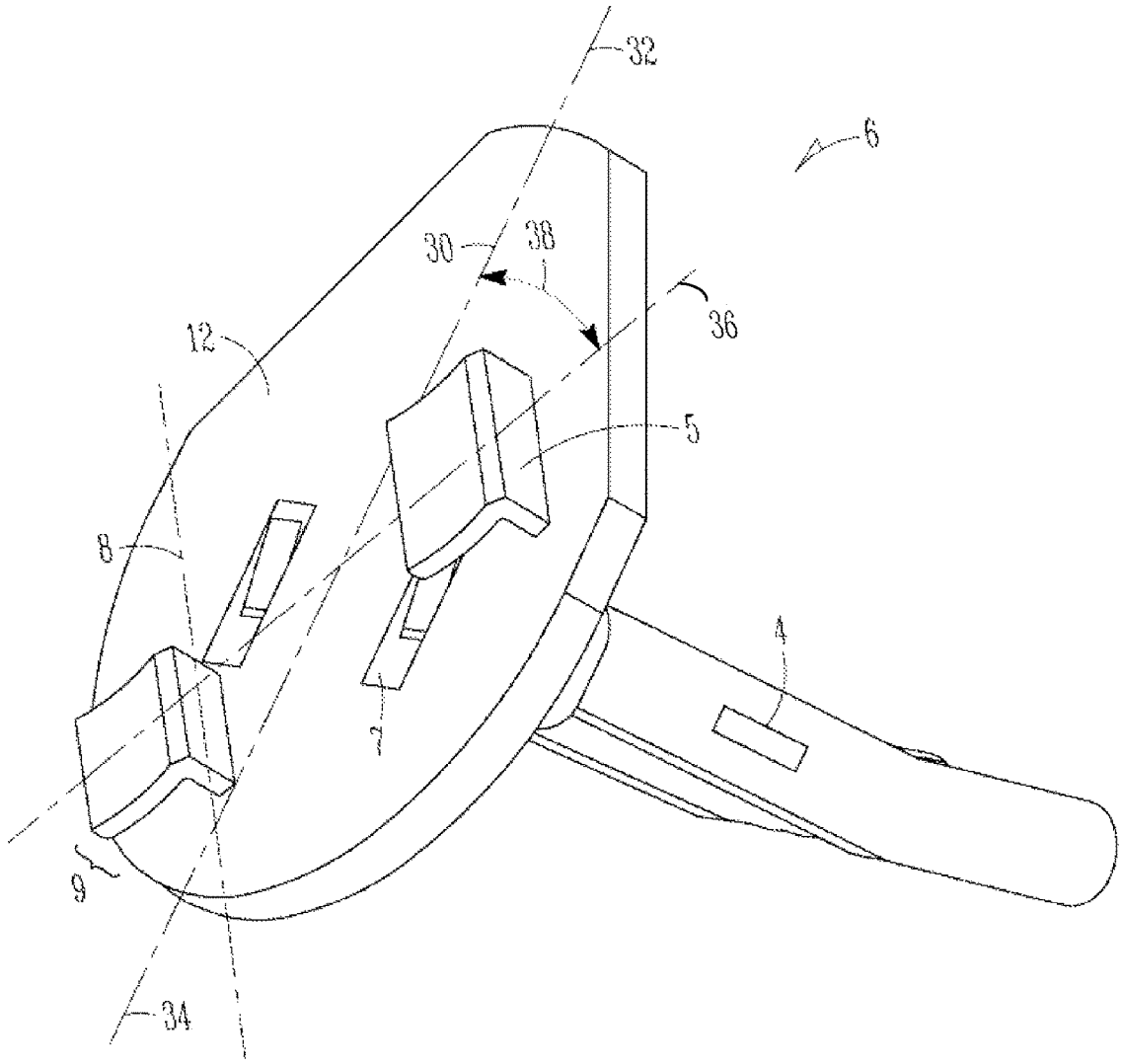
FIG. 2 is a perspective view, showing the back side of the device of FIG. 1 with attachment hooks for mounting.

FIG. 2 shows a perspective rear view of the device 6, in an assembled state. At least one hook 5 can be fixed on the back side 12 of the base 1 and each hook 5 can include an alignment axis 8 located parallel to a longitudinal axis of the at least one hook 5. An open end of the at least one hook 5 can form an aperture 9 between the open end of the at least one hook 5 and the back side 12 of the base 1. The device 6 with at least one hook 5 including an aperture 9 can allow the user of the device 6 to attach the device 6 to a chain link fence in any area of the ball players choice for use during the ball game, and thereafter detach the device 6 from the chain link fence when finished using the device for easy storage until the next use.

As shown in FIG. 2, the base 1 can have a vertical reference axis 30 with an upward end 32 and a downward end 34 and including an azimuthal axis 36 at an angle 38 from the vertical reference axis 30. In an example, two hooks 5 can be located along the azimuthal axis 32 where the alignment axes 8 of hooks 5 can be orthogonal to the azimuthal axis 32. In some examples, the hooks 5 are spaced evenly along an azimuthal axis 32 inclined at approximately 45 degrees from the vertical axis 30. In some examples, the hooks 5 are aligned so that the alignment axis 8 of the hooks 5 are located approximately orthogonally (i.e., perpendicular) to the azimuthal axis 32 in the plane formed by the back side 12 of the base 1.

Figure 3:
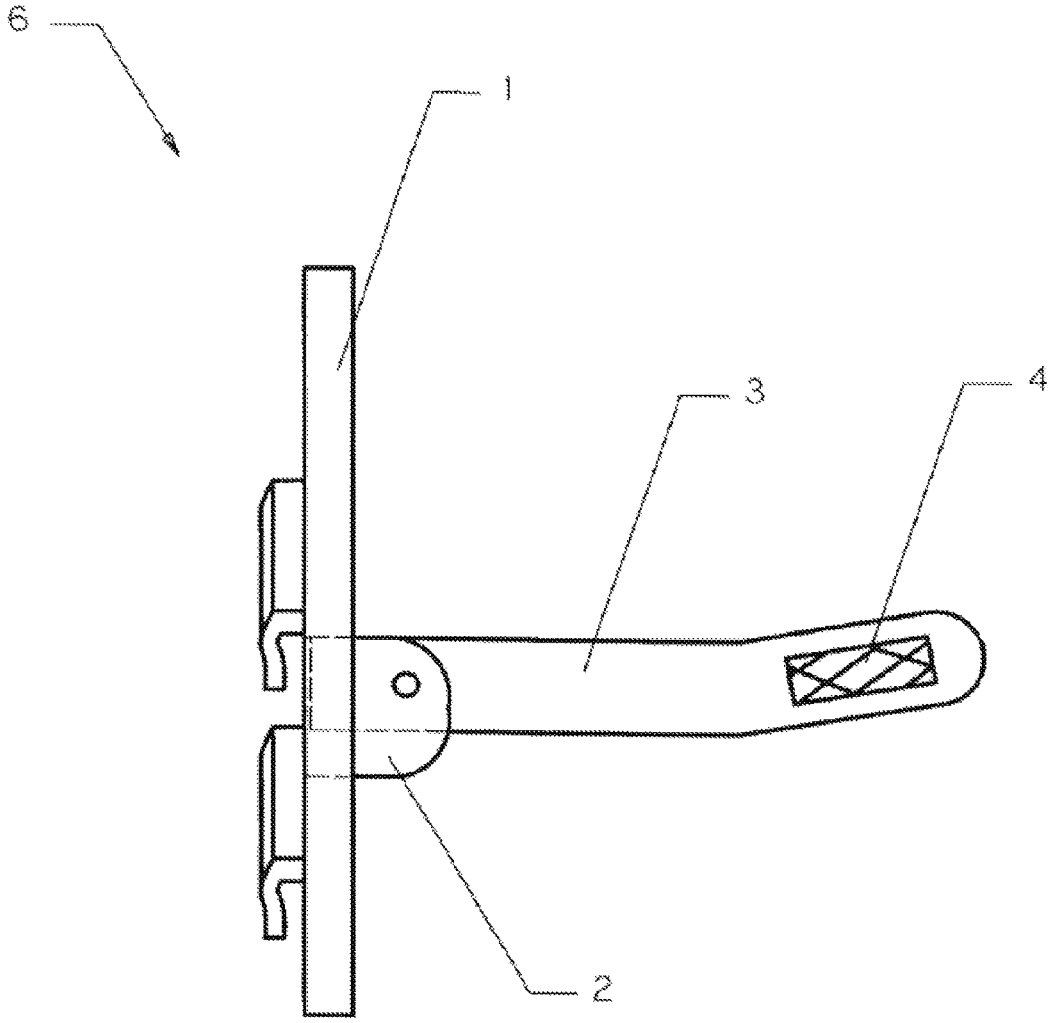
FIG. 3 is a side view, showing the organizing arms of the device of FIG. 1 rotated down 90 degrees in the extended position for placement and storage of the ball player equipment.

FIG. 3 shows the side view of the device 6. Although only one of the two arms 3 is visible in FIG. 3, both arms 3 are similarly oriented. The organizing arm 3 is attached to the pivot mount 2 and rotated down 90 degrees (horizontal) in an extended position for use once the device is attached to a chain link fence in an area of the ball player's choice. The organizing arm 3 includes the gripping material 4, fixed to the outside surface of the arm 3 to provide a place for attaching the ball players batting gloves. The organizing arm 3 also provides the placement and storage of the ball player's bat, the ball player's baseball glove, and ball cap.

Figure 4:
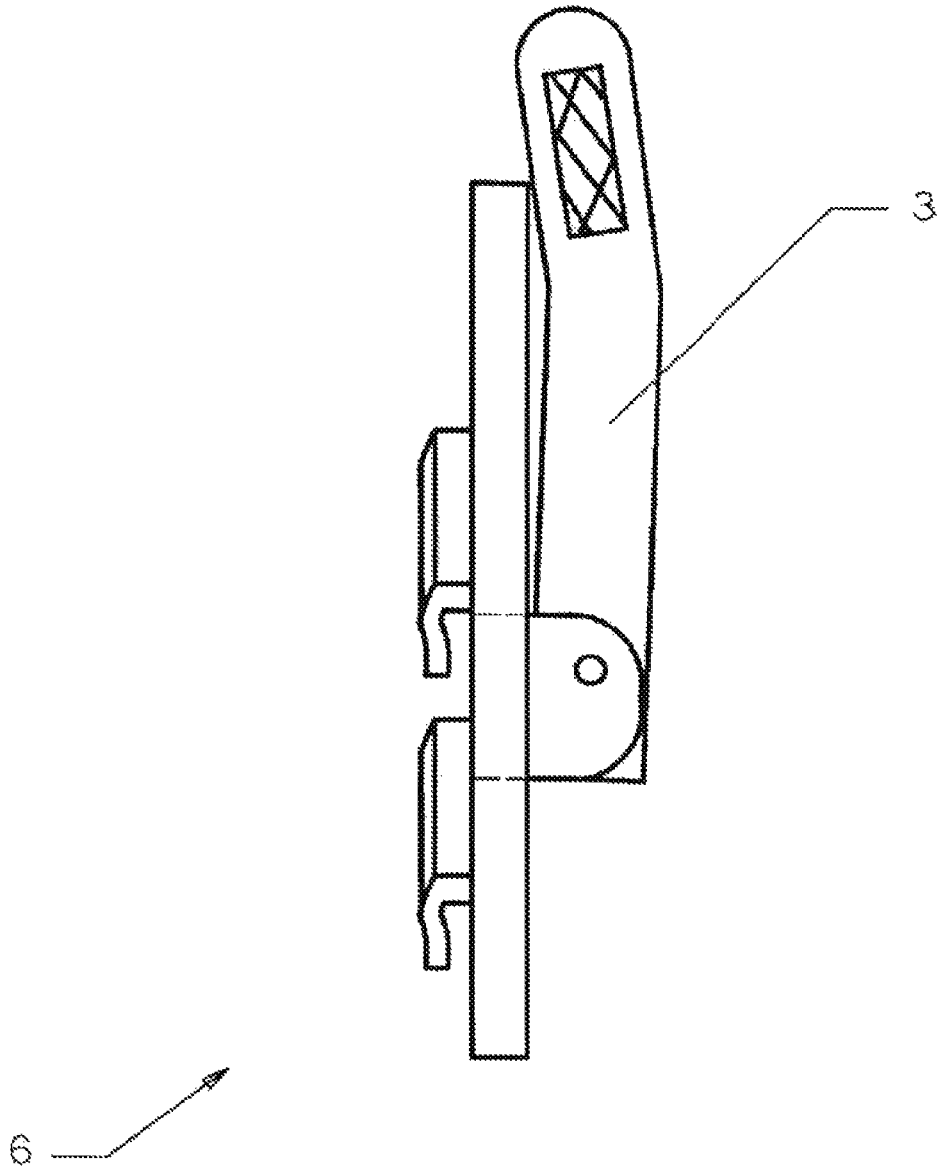
FIG. 4 is a side view, showing the organizing arms of FIG. 3 rotated 90 degrees in the up position for compact storage when not in use.

FIG. 4 shows the side view of the device 6 with the organizing arm 3 rotated up (vertical) in its retracted or stowed position. When not in use, the stowed position makes the device easy to detach from the chain link fence and also makes the device compact for easy storage.

In an example, the base 1 has two pivot mounts 2, attached to the base 1 to provide the 90 degree pivoting rotation point for the organizing arm 3, shown in the extended position. The pivoting organizing arms 3, when rotated about pivot mounts 2, extend generally orthogonally (i.e., perpendicular) to the base 1 and provide placement and storage for the individual baseball player's equipment, baseball or softball bat, one or a pair of batting gloves, the baseball glove, or a baseball cap. This can be achieved by placing the device on the chain link fence in the area of the team member's choice, then physically rotating the organizing arms 3 to the down (or horizontal) position for the team member's equipment placement for use during a ball game so that the organizing arms 3 are generally orthogonal to the base 1. The gripping material 4 is fixed on the outside surface of one or both of the organizing arms 3, for the attachment of the players batting gloves or other equipment or accessories. When finished using the device 6, the player's equipment is removed, the organizing arms 3 are rotated 90 degrees to the stored (or vertical) position and removed from the chain link fence for easy storage.

Figure 5:
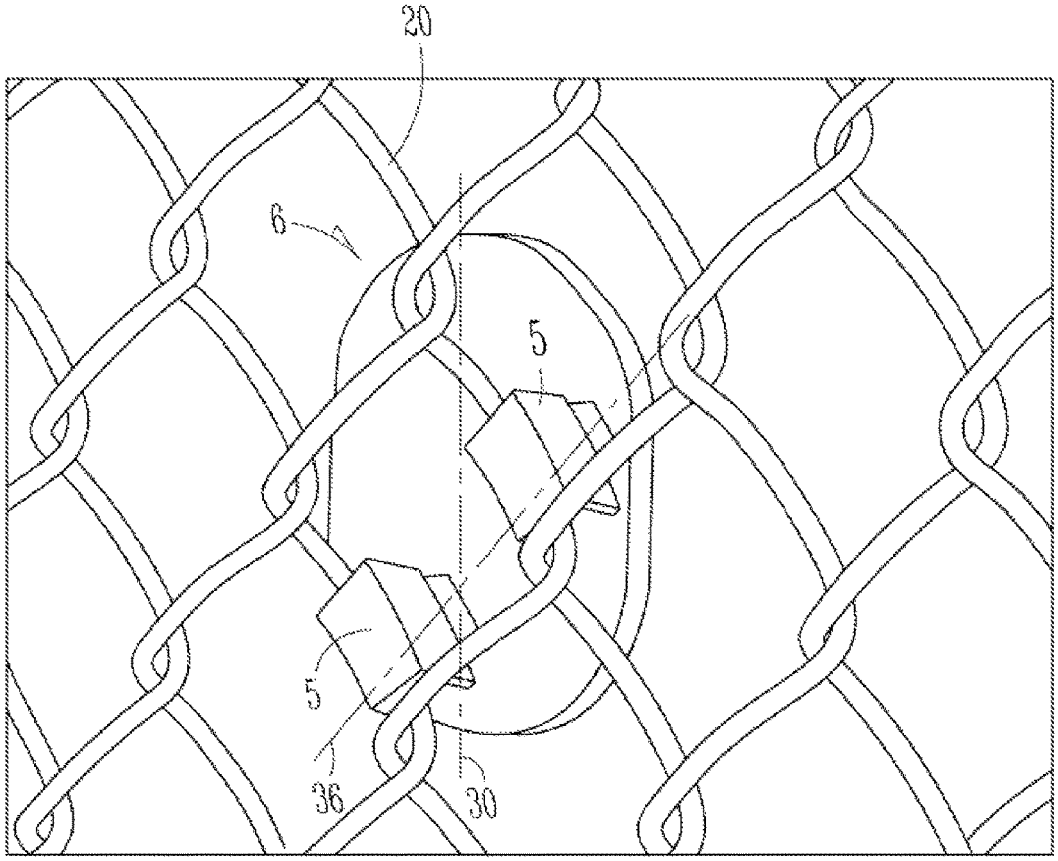
FIG. 5 is a perspective view, showing the back side of the device of FIG. 1 with the attachment hooks removably attached to a portion of chain link fence.

FIG. 5 shows the device 6 removably attached to a portion of chain link fence 20. In an example, the device 6 can removably attach to a chain link fence 20 by engaging at least one hook 5 in an interference fit with the chain link fence 20. As used here, the term interference fit can include a friction fit, a press fit or any other intimate contact between at least two surfaces where friction is generated by virtue of interaction between the at least two surfaces. In another example, the device 6 can removably attach to a chain link fence 20 by engaging at least two hooks 5 in an interference fit with the chain link fence. In an example, the at least two hooks 5 can be located approximately orthogonally to the azimuthal axis 32 and can be spaced at approximately two inches. In an example, the at least two hooks 5 can be located approximately orthogonally to the azimuthal axis 32 and can be spaced at approximately 1.75 inches. As shown in FIG. 5, the hooks 5 are configured to engage two sides of a diamond shaped structure in the chain link fence 20. In other examples, more or less than the two hooks 5 of FIG. 5 can be used to removably attach the device 6 to the chain link fence 20 and the hooks 5 can be configured in any location on the back side 12 of base 1 suitable to engage the fence 20.

Chain link fence is a type of physical barrier comprising a wire mesh material generally woven from steel wire. In some examples, the steel wire is galvanized or otherwise coated to protect the mesh material from corrosion. Mesh material coatings can include, but are not limited to, polymer materials and metals such as aluminum. In some examples, the wire is bent in a zig-zag fashion and combined with similarly shaped wire components to create a wire mesh forming 'diamond-shaped' openings. In general, the diamond-shaped openings can be shapes that include, but are not limited to, squares, rectangular or other four-sided shapes. In some examples, the diamond-shaped openings are generally square shapes measuring approximately two inches on a side. In other examples, the diamond-shaped openings are generally square shapes measuring approximately 1.75 inches on a side.

Figure 6:
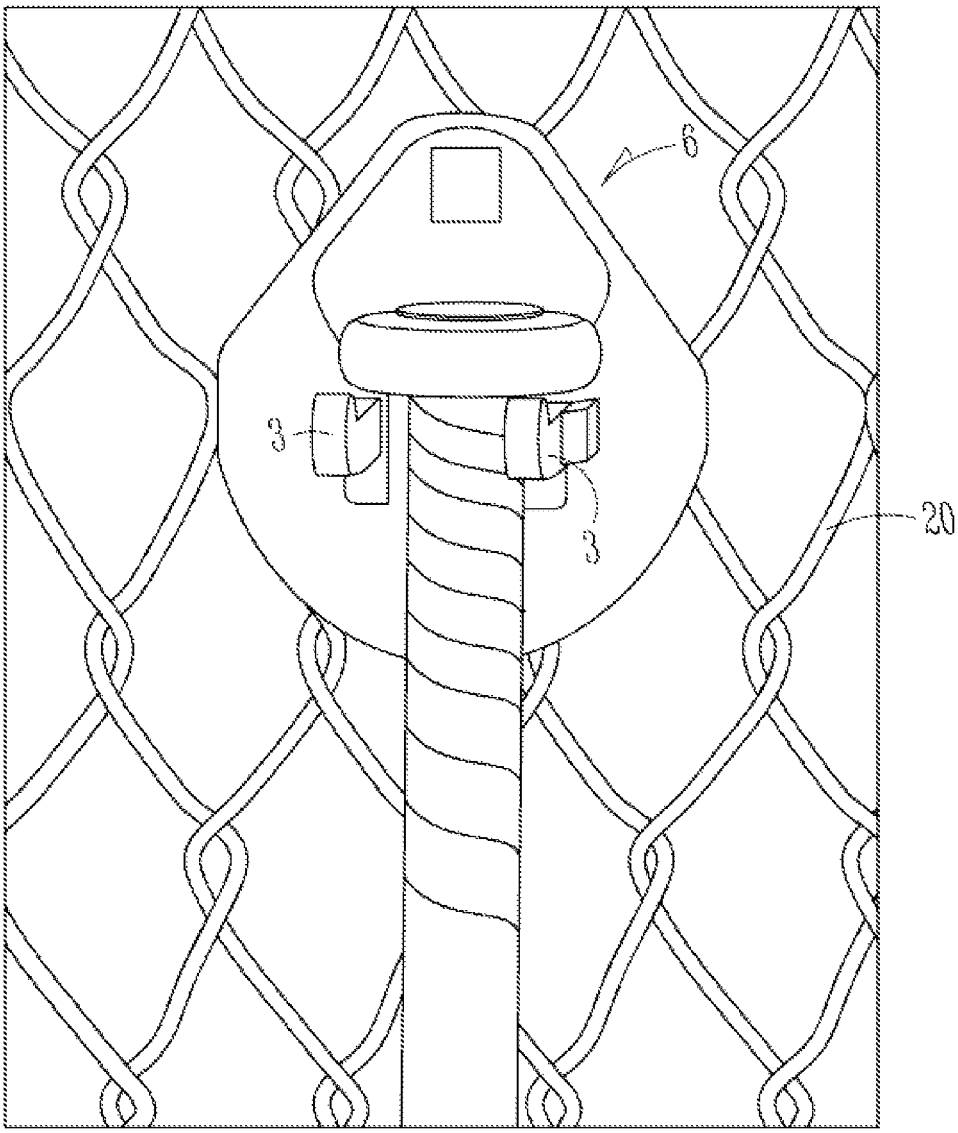
FIG. 6 is a front view, showing the device of FIG. 1 with a baseball bat releasable stored on the organizing arms.

FIG. 6 shows the device 6 removably attached to a portion of chain link fence 20 and a baseball bat releasable stored on the organizing arms 3 of device 6 where the organizing arms 3 are in the rotated down (horizontal) position. In some examples, the distal axis 44 of the distal portion 42 of organizing arms 3 can be offset from the central axis 48 of a central portion 46 of organizing arms 3 to prevent the baseball bat from sliding off the organizing arms 3 (see FIG. 1).

Figure 7:
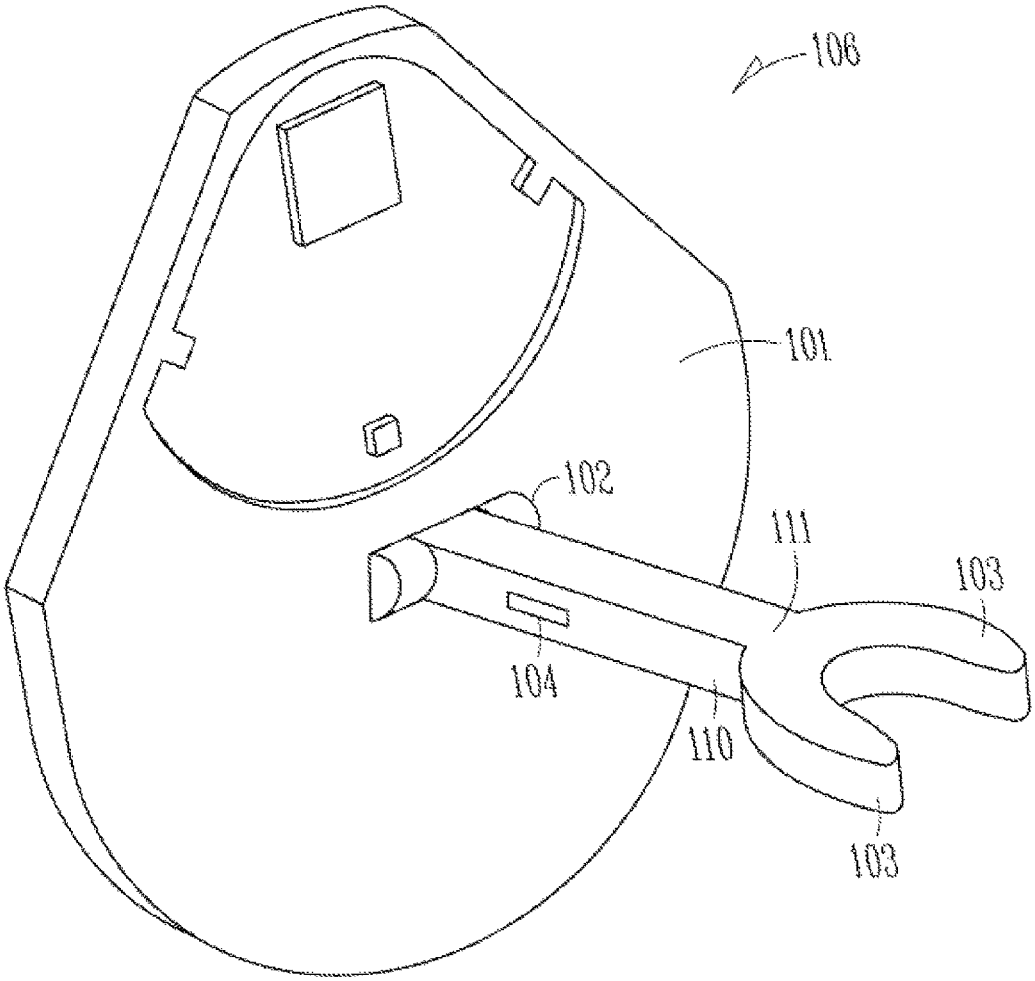
FIG. 7 is a perspective view, showing the front side of another example of an equipment organizer device.

FIG. 7 shows a perspective front view of another example of an organizer device 106. The device 106 can include a base 101, at least one pivot mount 102, a single extension 110 rotatable from a first position to a second position as similarly described above for the organizing arms 3 of device 6, and a forked end portion 111. Arms 103 can be connected to or integral with the forked end portion 111 and configured as similarly described above for the device 6 to releasably store a baseball bat. The device 106 can include one or more gripping materials 104 for storing gloves or other sports equipment. In an example, the gripping material

104 can also be located on an outside surface of the arms 103 in addition to or as an alternative to being on the extension 110.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventor also contemplates examples in which only those elements shown or described are provided. Moreover, the present inventor also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first", "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A sports equipment organizing device comprising:

a base with a front surface and a back surface;

a first arm including a proximal portion, the first arm rotatably connected to the front surface of the base;

a first pivot mount located between the proximal portion of the first arm and the front surface, the first pivot mount configured to allow the first arm to rotate with respect to the front surface;

a first slot located in the base extending from the front surface to the back surface, the first slot configured to interfere with the proximal portion of the first arm to limit the rotation of the first arm with respect to the front surface;

a second arm including a proximal portion, the second arm rotatably connected to the front surface of the base;

a second pivot mount located between the proximal portion of the second arm and the front surface, the second pivot mount configured to allow the second arm to rotate with respect to the front surface;

a second slot located in the base extending from the front surface to the back surface, the second slot configured to interfere with the proximal portion of the second arm to limit the rotation of the second arm with respect to the front surface, wherein the first and second arms are configured for releasably storing a baseball bat; and at least one hook attached to the back surface of the base, wherein the at least one hook is configured to removably attach the base to a chain link fence.

2. The device of claim 1 wherein each of the first and second arms includes a distal portion opposite the proximal portion and a central portion connecting the distal and proximal portions, wherein each of the distal portions is offset from the respective central portion to define a notch, wherein each of the notches is configured to locate a baseball bat at a specified distance from the first and second pivot mounts.

3. The device of claim 1 wherein the at least one hook includes two hooks attached to the back surface.

4. The device of claim 3 wherein the two hooks are located along an azimuthally inclined axis at an angle of approximately 45 degrees from a vertical axis.

5. The device of claim 4 wherein the hooks are generally downward facing along the azimuthally inclined axis.

6. The device of claim 1 wherein the first and second arms are movable from a first position generally parallel to the front surface to a second position that is generally orthogonal to the front surface.

7. The device of claim 1 comprising a gripping material attached to an outside surface of at least one of the first and second arms, wherein the gripping material is configured for releasably storing batting gloves or other personal baseball equipment.

8. The device of claim 1, wherein the shape of the base is a non-symmetric geometric shape.

9. The device of claim 1, wherein the shape of the base is a planar symmetric shape.

10. The device of claim 1, wherein the shape of the base is a round shape.

11. The device of claim 1, wherein the shape of the base is a square shape.

12. The device of claim 1, wherein the shape of the base is a triangular shape.

13. A method of using a sports equipment organizing device to organize sports equipment, the method comprising:

providing a device comprising:

a base with a front surface and a back surface;

a first arm including a proximal portion, the first arm rotatably connected to the front surface of the base;

a first slot located in the base extending from the front surface to the back surface, the first slot configured to limit the rotation of the first arm with respect to the front surface;

a second arm including a proximal portion, the second arm rotatably connected to the front surface of the base;

a second slot located in the base extending from the front surface to the back surface, the second slot configured to limit the rotation of the second arm with respect to the front surface;

locating an appropriate portion of chain link fence;

placing the back surface of the device substantially against the chain link fence so that the at least one hook removably engages a portion of a diamond-shaped structure in the chain link fence; and storing the baseball bat between the first and second arms.

14. The method of claim 13 further comprising:

storing personal baseball equipment by hanging the equipment from gripping material on an outside surface of at least one of the first and second arms.

15. The method of claim 13 wherein the first and second arms are movable from a first position to a second position after the device is attached to the fence and prior to storing the baseball bat, the first position being generally parallel to the front surface and the second position being generally orthogonal to the front surface.

16. A sports equipment organizing device comprising:

a base with a front surface and a back surface;

an extension arm including a proximal portion rotatably connected to the front surface of the base and a distal portion opposite the proximal portion, the distal portion including a forked end portion, wherein the forked end portion is configured to releasably store a baseball bat;

at least one pivot mount located between the proximal portion of the extension arm and the front surface, the at least one pivot mount configured to allow the extension arm to rotate with respect to the front surface;

a slot located in the base extending from the front surface to the back surface, the slot configured to interfere with the proximal portion of the extension arm to limit the rotation of the extension arm with respect to the front surface; and at least one hook attached to the back surface of the base, wherein the at least one hook is configured to removably attach the base to a chain link fence.

17. The device of claim 16 wherein the at least one hook includes two hooks attached to the back surface.

18. The device of claim 17 wherein the two hooks are located along an azimuthally inclined axis at an angle of approximately 45 degrees from a vertical axis.

19. The device of claim 18 wherein the hooks are generally downward facing along the azimuthally inclined axis.

20. The device of claim 16 comprising a gripping material attached to an outside surface of the extension, wherein the gripping material is configured for releasably storing batting gloves or other personal baseball equipment.

* * * * *